US009718034B1

(12) United States Patent
Lai et al.

(10) Patent No.: US 9,718,034 B1
(45) Date of Patent: Aug. 1, 2017

(54) AERATION DEVICE

(71) Applicants: Hung-Shing Lai, Taichung (TW); Ken-An Chen, Taichung (TW)

(72) Inventors: Hung-Shing Lai, Taichung (TW); Ken-An Chen, Taichung (TW)

( * ) Notice: Subject to any disclaimer, the term of this patent is extended or adjusted under 35 U.S.C. 154(b) by 0 days.

(21) Appl. No.: 15/360,986

(22) Filed: Nov. 23, 2016

(51) Int. Cl.
*B01F 3/04* (2006.01)
*B01F 15/00* (2006.01)

(52) U.S. Cl.
CPC .... *B01F 3/04531* (2013.01); *B01F 15/00662* (2013.01); *B01F 2003/04631* (2013.01); *B01F 2003/04673* (2013.01); *B01F 2015/0011* (2013.01)

(58) Field of Classification Search
CPC .. B01F 3/0446; B01F 3/0451; B01F 3/04517; B01F 3/04531; B01F 5/10; B01F 5/104; B01F 15/00662; B01F 2003/04631; B01F 2003/04673; B01F 2015/0011
USPC ..... 261/84, 121.1
See application file for complete search history.

(56) References Cited

U.S. PATENT DOCUMENTS 4,504,388 A * 3/1985 Desbos ..... B01F 3/04248 210/130
8,292,271 B2 * 10/2012 Fujisato ..... A01K 63/042 210/220

* cited by examiner

*Primary Examiner* — Charles Bushey

(57) ABSTRACT

An aeration device includes a pipe, connection members and a first connection unit which is connected to the connection member. The first connection unit includes a first connector, a first connection part, a one-way member, a second connector, a turbine unit and a shell. When air enters into the pipe, the shell guides the air and liquid in the pound into the turbine unit via the second and third rooms so as to increase the mixing feature of the air and the liquid in the pound.

9 Claims, 11 Drawing Sheets

AERATION DEVICE

BACKGROUND OF THE INVENTION

1. Fields of the Invention

The present invention relates to an aeration device, and more particularly, to an aeration device having a shell which guides air and liquid entering to the turbine unit to increase the efficiency of mixing of air and liquid in the pound.

2. Descriptions of Related Art

The conventional aeration device generally includes a case, a motor and turbine blades. The motor is received in the room of the case and the shaft of the motor drives the turbine blades. In order to avoid the motor from rusting, the room is designed to be water-proof such that the motor is not affected by the chemical material or metal in the liquid. Besides, the motor needs electric power to operate, and this may not be convenient for some areas.

The present invention intends to provide an aeration device which has a shell to guide the air and liquid into the turbine unit to increase the operational efficiency.

SUMMARY OF THE INVENTION

The present invention relates to an aeration device and comprises a having a first connection portion. The pipe is connected with a piping system. A connection member has a second connection portion on an outside thereof so as to be securely connected to the first connection portion. The connection member has a first threaded portion defined in the inside thereof and has a hexagonal flange extending radially from one end thereof.

A connection unit is connected to the connection member and comprises a first connector, a first connection part and a one-way member which is a bead in the embodiment. The first connector has a second threaded portion defined in the outside thereof. The second threaded portion is connected to the first threaded portion to connect the first connector to the connection member. The first connector has a cone-shaped first opening which faces the interior of the pipe. The first connector has an inclined first contact portion, and a first passage is defined between the first opening and the first contact portion, and communicates with the first opening. A first room is defined in the first connector and communicates with the first passage. The first passage is defined between the first opening and the first room. The first connection part is received in the first room and has a first assembly portion which communicates with the first room. Multiple third passages are defined in the first connection part and located around the first assembly portion. The third passages communicate with the first room. The one-way member contacts the first contact portion to seal the first passage. The one-way member is pushed by air entering into the pipe via the first opening and moved upward to open the first passage.

A second connector is connected to the connection unit and has a second assembly portion which is inserted into the first assembly portion of the first connection part. The second assembly portion has a third assembly portion. The second connector has multiple ribs which are connected between the second assembly portion and the inner periphery of the second connector. A second room is defined in the second connector and communicates with the third passages.

A turbine unit is pivotably connected to the second connector and has a bearing set, a turbine seat and multiple blades. The bearing set is received in the third assembly portion. The turbine seat is pivotably connected to the second connector. The blades are connected to the turbine seat which rotates with the second connector.

A shell is connected to outside of the second connector to hide the first connection unit and the second connector in the shell. A third room is defined in the shell and communicates with the second room. The third room is located corresponding to the pipe and the second connector. The shell has a first end at the lower end thereof. The first end is located close to the first axis of the pipe, or the first end is located lower than the first axis of the pipe. The shell has a second end on the top thereof. The shell has a curved recess which is matched with the pipe.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
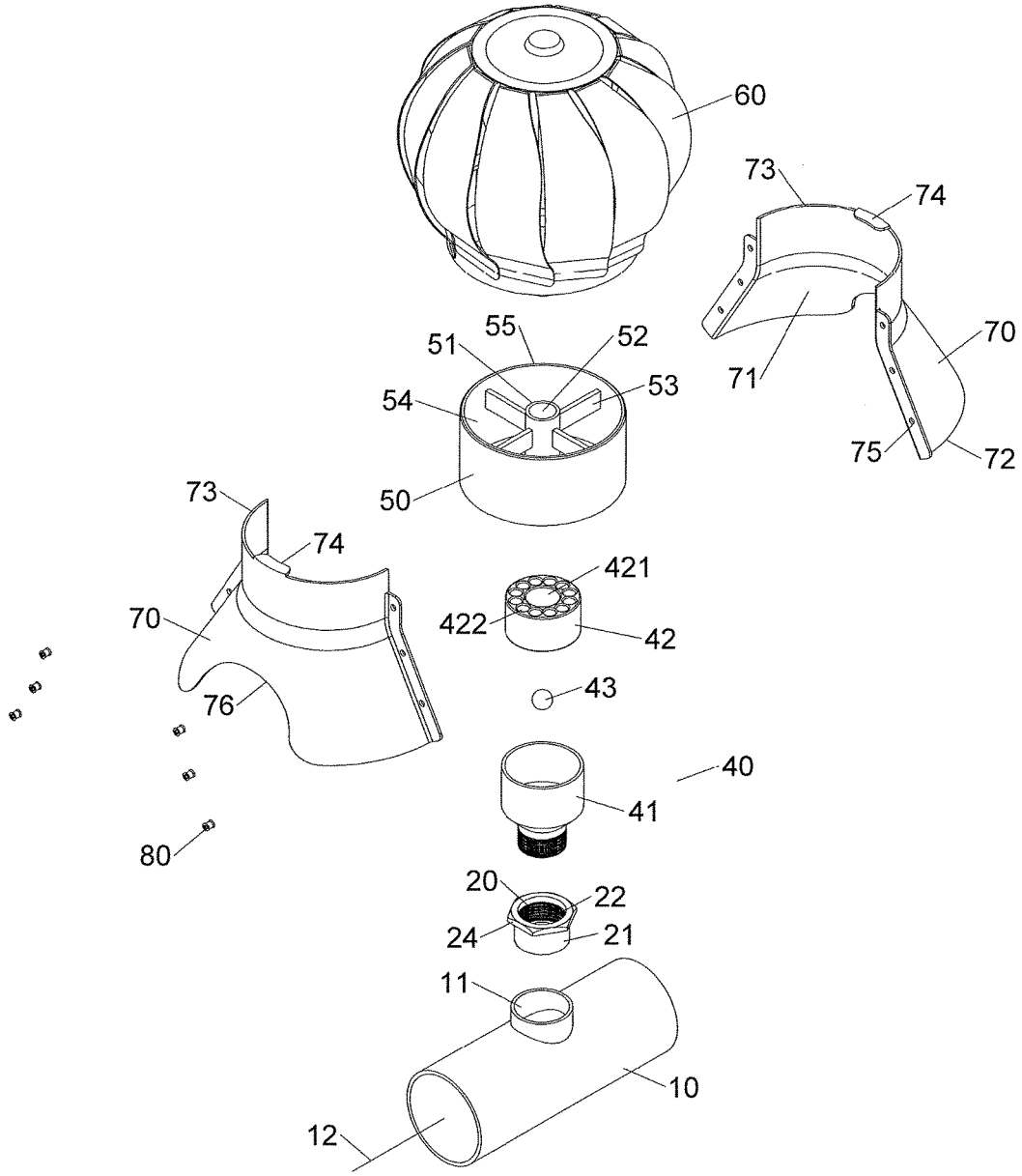
FIG. 1 is an exploded view of the aeration device of the present invention.
Figure 3:
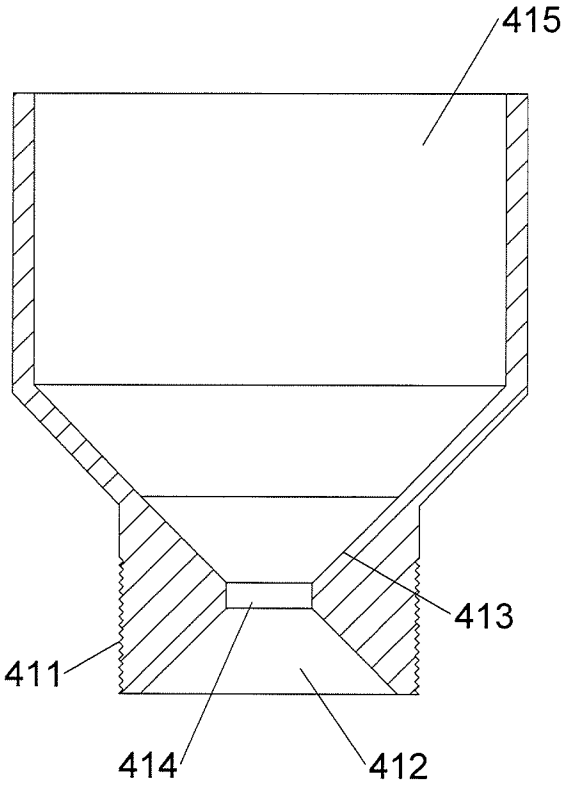
FIG. 3 is a cross sectional view, taken along line 3-3 of FIG. 2.
Figure 2:
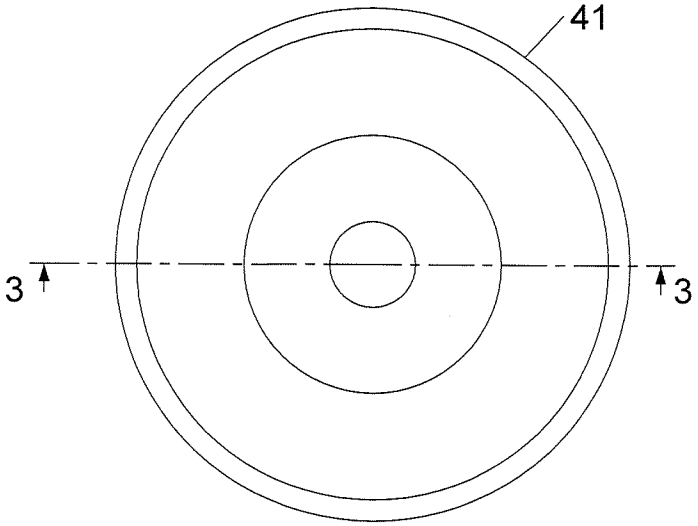
FIG. 2 is a top view of the first connector of the aeration device of the present invention.
Figure 4:
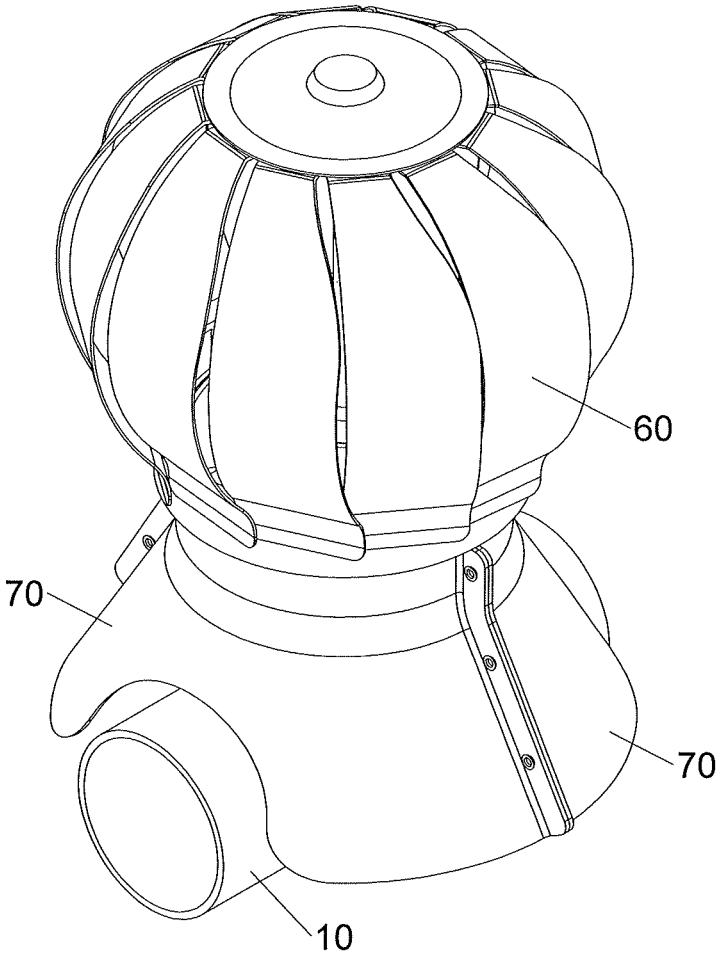
FIG. 4 is a perspective view to show the aeration device of the present invention.
Figure 5:
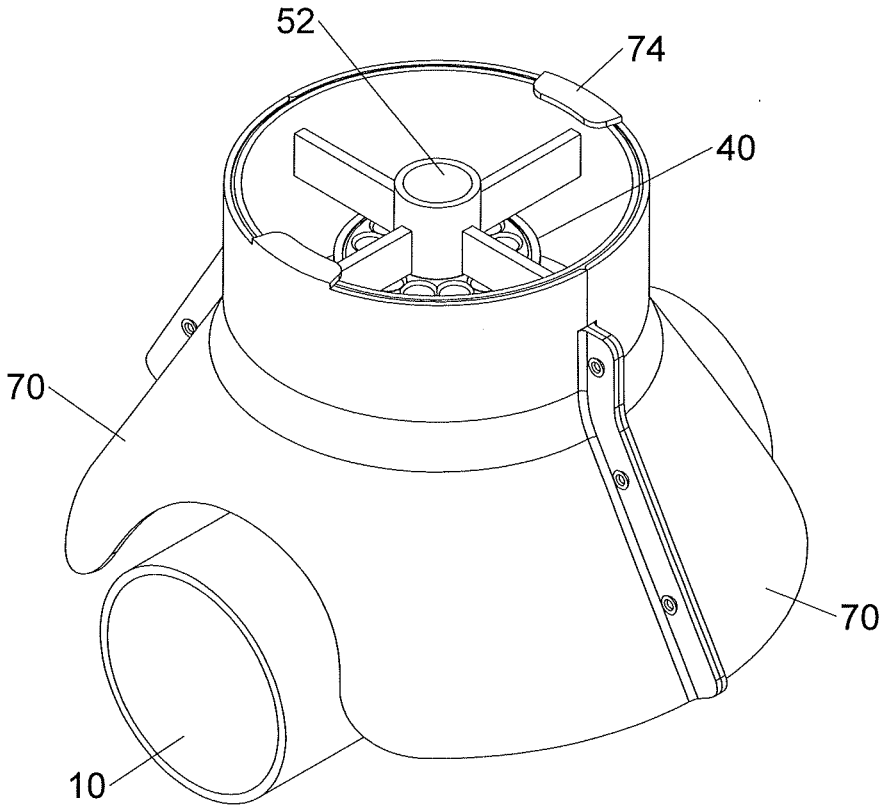
FIG. 5 is a perspective view to show a portion of the aeration device of the present invention.

Referring to FIGS. 1 to 5, the aeration device of the present invention comprises a pipe 10, a connection member 20, a connection unit 40, a second connector 50, a turbine unit 60, a shell 70 and multiple fasteners 80.

The pipe 10 has a first connection portion 11 which has a first axis 12. The pipe 10 is connected with a piping system which is not shown, the piping system introduces air into the pipe 10. The connection member 20 has a second connection portion 21 on the outside thereof, and the second connection portion 21 is securely connected to the first connection portion 11. The connection member 20 has a first threaded portion 22 defined in the inside thereof. A hexagonal flange 24 extends radially from one end of connection member 20, so that the user can use a tool to rotate the connection member 20.

The connection unit 40 is connected to the connection member 20 and comprises a first connector 41, a first connection part 42 and a one-way member 43 which is a bead in this embodiment. The first connector 41 has a second threaded portion 411 defined in the outside thereof, and the second threaded portion 411 is connected to the first threaded portion 22 to connect the first connector 41 to the connection member 20. The first connector 41 has a cone-shaped first opening 412 which faces the interior of the pipe 10. The first connector 41 has an inclined first contact portion 413, and a first passage 414 is defined between the first opening 412 and the first contact portion 413, and communicates with the first opening 412. A first room 415 is defined in the first connector 41 and communicates with the first passage 414. The first passage 414 is defined between the first opening 412 and the first room 415. The first connection part 42 is received in the first room 415 and has a first assembly portion 421 which communicates with the first room 415. Multiple third passages 422 are defined in the first connection part 42 and located around the first assembly portion 421. The third passages 422 communicates with the first room 415. The one-way member 43 contacts the first contact portion 413 to seal the first passage 414. Air is introduced into the pipe 10 and passes through the first opening 412, and the one-way member 43 in the first room 415 is pushed by the air and is moved upward to open the first passage 414.

The second connector 50 is connected to the connection unit 40 and has a second assembly portion 51 which is inserted into the first assembly portion 421 of the first connection part 42. The second assembly portion 51 has a third assembly portion 52 which is a circular hole. Multiple ribs 53 are connected between the second assembly portion 51 and the inner periphery of the second connector 50. A second room 54 is defined in the second connector 50 and communicates with the third passages 422. The second connector 50 has a first engaging portion 55 at one end thereof.

The turbine unit 60 is pivotably connected to the second connector 50 and has a bearing set, a turbine seat and multiple blades. The bearing set is received in the third assembly portion 52. The turbine seat is pivotably connected to the second connector 50. The blades are connected to the turbine seat which rotates with the second connector 50.

The shell 70 is connected to outside of the second connector 50 to hide the first connection unit 40 and the second connector 50 in the shell 70. A third room 71 is defined in the shell 70 and communicates with the second room 54. The third room 71 is located corresponding to the pipe 10 and the second connector 50. The shell 70 has a first end 72 at the lower end thereof. The first end 72 is located close to the first axis 12 of the pipe 10, or the first end is located lower than the first axis 12 of the pipe 10. The shell 70 has a second end 73 on the top thereof. The shell 70 has a curved recess 76 which is matched with the pipe 10. In this embodiment, the shell 70 includes two parts and each part has multiple connection holes 75. The two parts are connected to each other and multiple fasteners 80 extend through the connection holes 75 of the two parts to form the shell 70.

Figure 7:
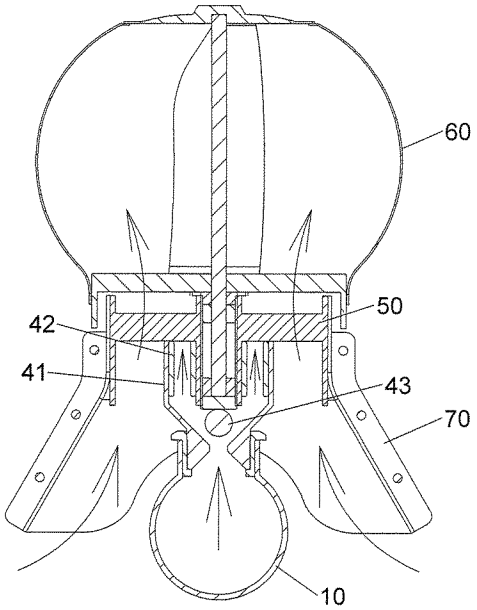
FIG. 7 is a cross sectional view, taken along line 7-7 of FIG. 2.
Figure 6:
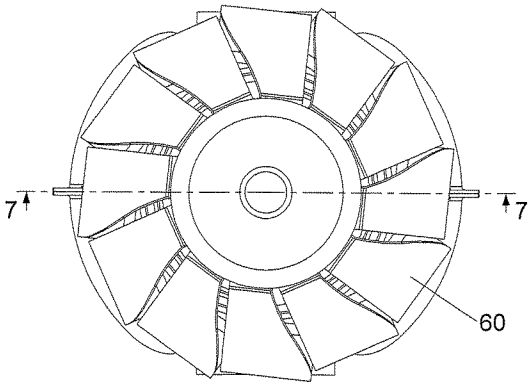
FIG. 6 is a top view of the aeration device of the present invention.

As shown in FIGS. 6 and 7, the connection member 20 is connected to the pipe 10, and the first connection unit 40 is connected to the connection member 20. The second connector 50 is connected to the first connection unit 40. The turbine unit 60 is pivotably connected to the second connector 50. The shell 70 is mounted to the outside of the second connector 50 to hide the first connection unit 40 and the second connector 50 in the shell 70.

Air enters into the pipe 10, and the one-way member 43 is pushed by the air in the pipe 10 and moves upward in the first room 415 to open the first passage 414. The air passes through the first passage 414, the first room 415, the third passages 422 and the second room 54, and enters into the turbine unit 60. The blades of the turbine unit 60 are rotated 360 degrees because the air flows upward. When the air enters into the pipe 10, the shell 70 guides the liquid to enter into the second room 54 and the third room 71, and the air enters into the turbine unit 60. Therefore, the liquid and the air are mixed efficiently.

Figure 8:
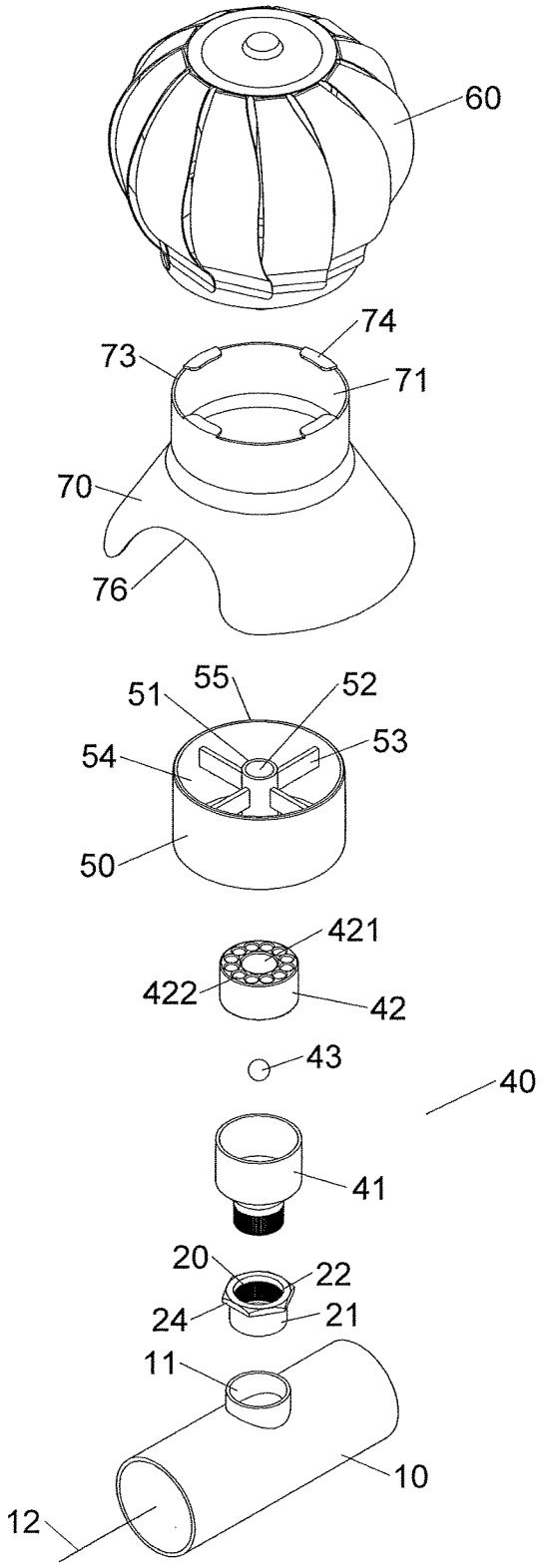
FIG. 8 is an exploded view of the second embodiment of the aeration device of the present invention.

As shown in FIG. 8, the shell 70 is an integral shell and is mounted to outside of the second connector 50. The second engaging portion 74 is engaged with the first engaging portion 55. There is no fasteners 80 needed.

Figure 9:
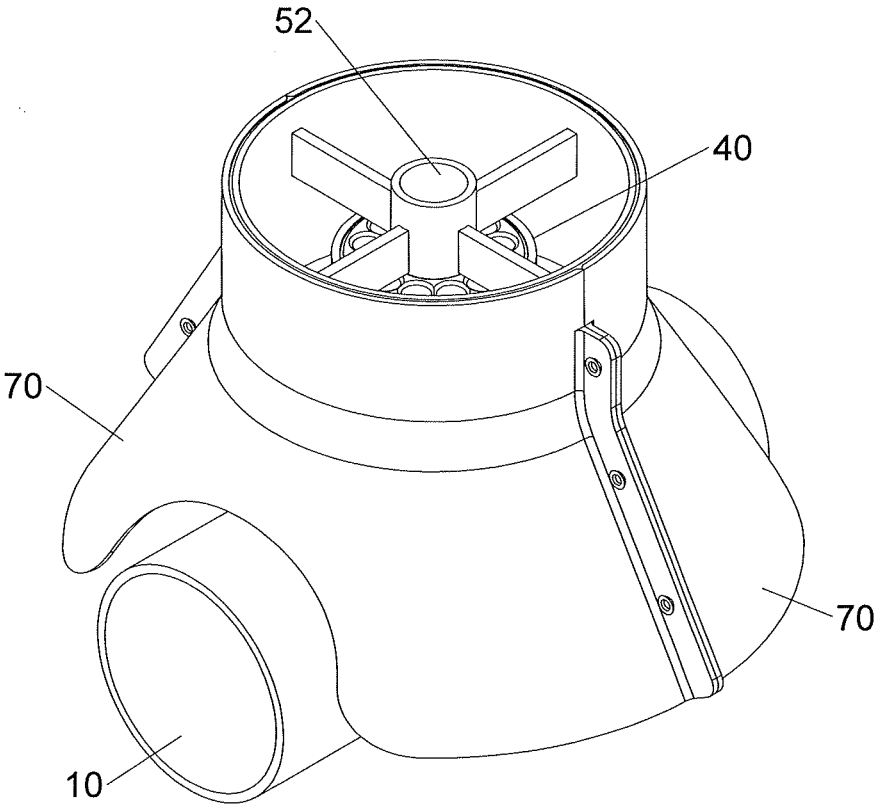
FIG. 9 is a perspective view to show the third embodiment of the aeration device of the present invention.

As shown in FIG. 9, the shell 70 does not have the second engaging portion 74. The shell 70 is force-fitted to the second connector 50.

Figure 10:
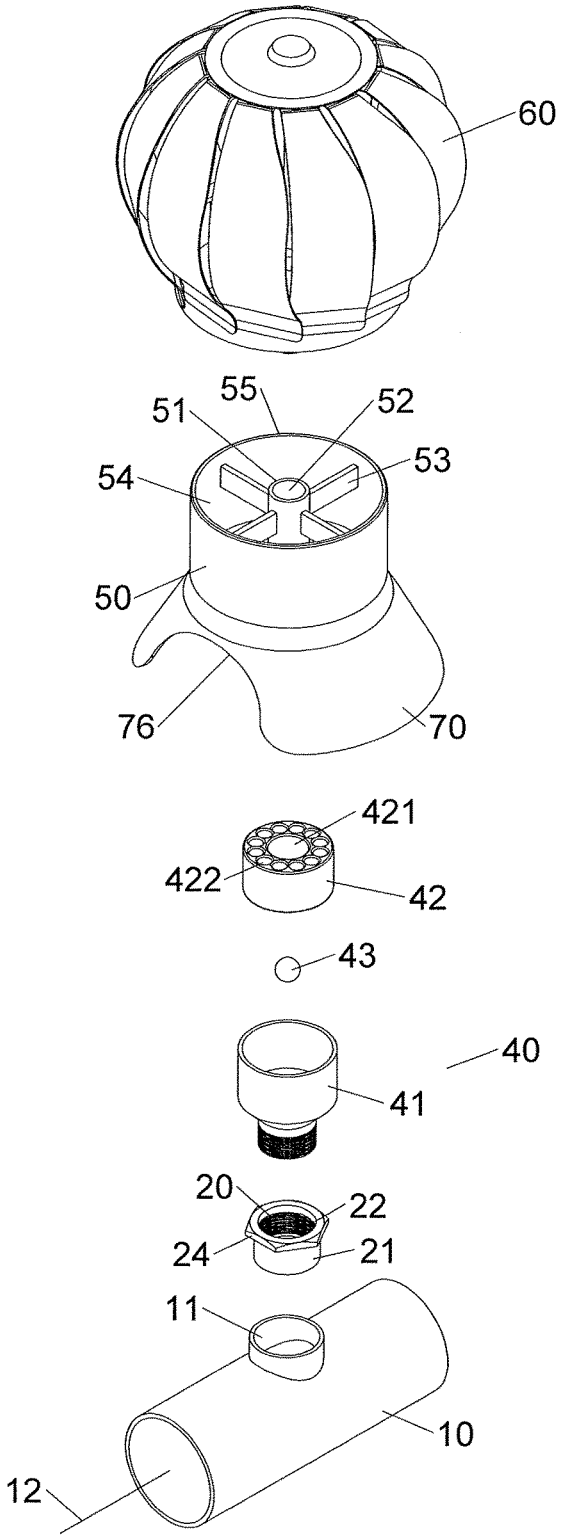
FIG. 10 is an exploded view of the fourth embodiment of the aeration device of the present invention.
Figure 12:
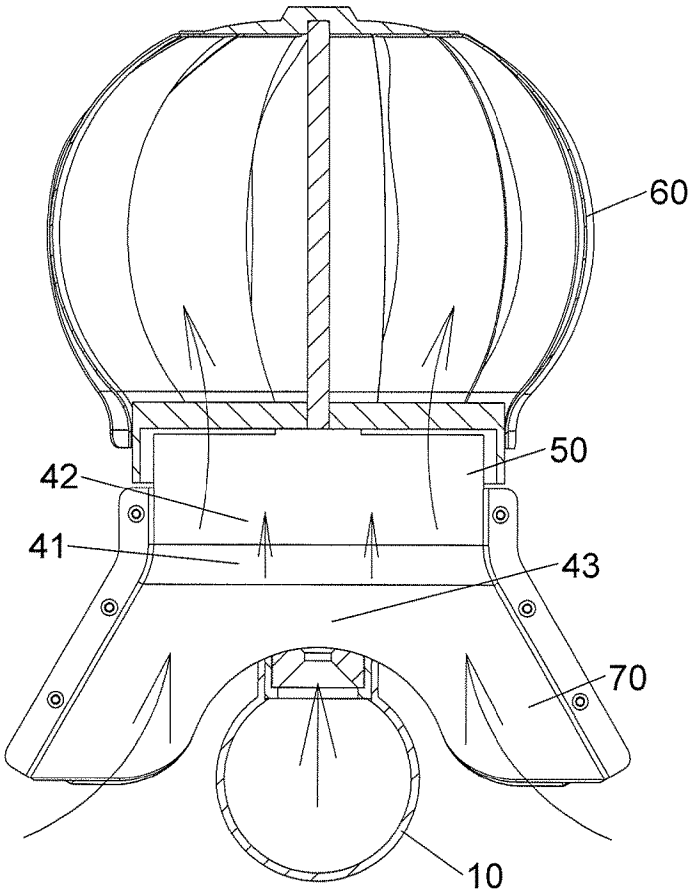
FIG. 12 is a cross sectional view, taken along line 12-12 of FIG. 11.
Figure 11:
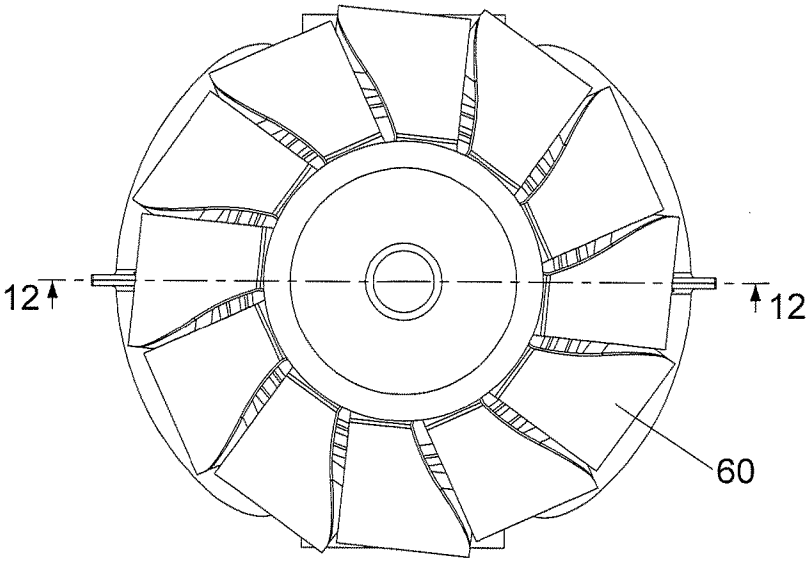
FIG. 11 is a top view of the fourth embodiment of the aeration device of the present invention.

As shown in FIGS. 10 to 12, the shell 70 is an integral shell and is integrally formed with the second connector 50.

Figure 13:
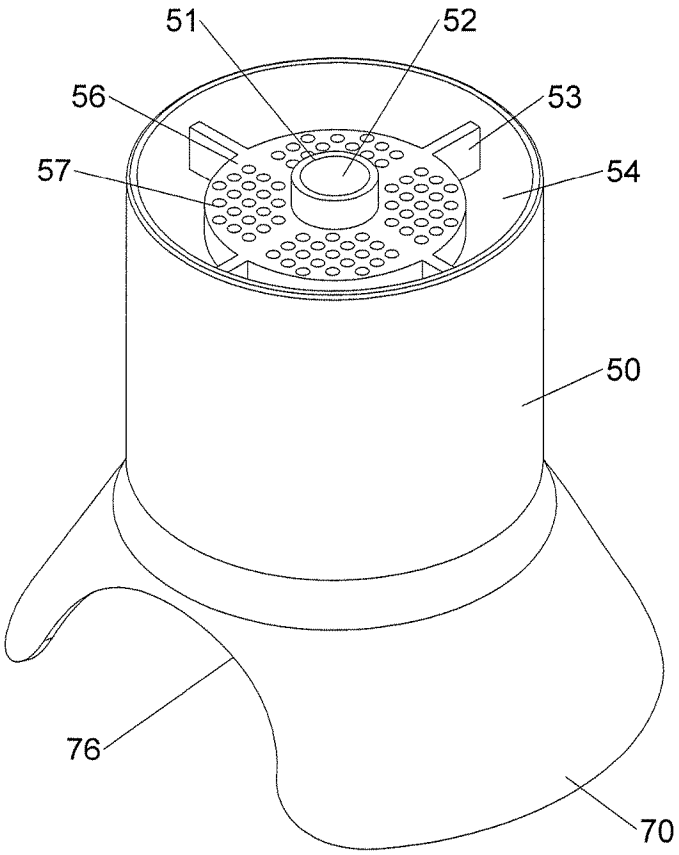
FIG. 13 is a perspective view to show the second connector of the fifth embodiment of the aeration device of the present invention.

As shown in FIG. 13, the second connector 50 has a first disk 56 which is connected to the ribs 53 and has multiple first apertures 57. The air passes through the third passages 422 of the first connection part 42 and flows through the second room 54 and the first aperture 57 and enters into the turbine unit 60. The first disk 56 is integrally connected to the second connector 50, or the first disk 56 is an individual part and connected to the second connector 50.

Figure 14:
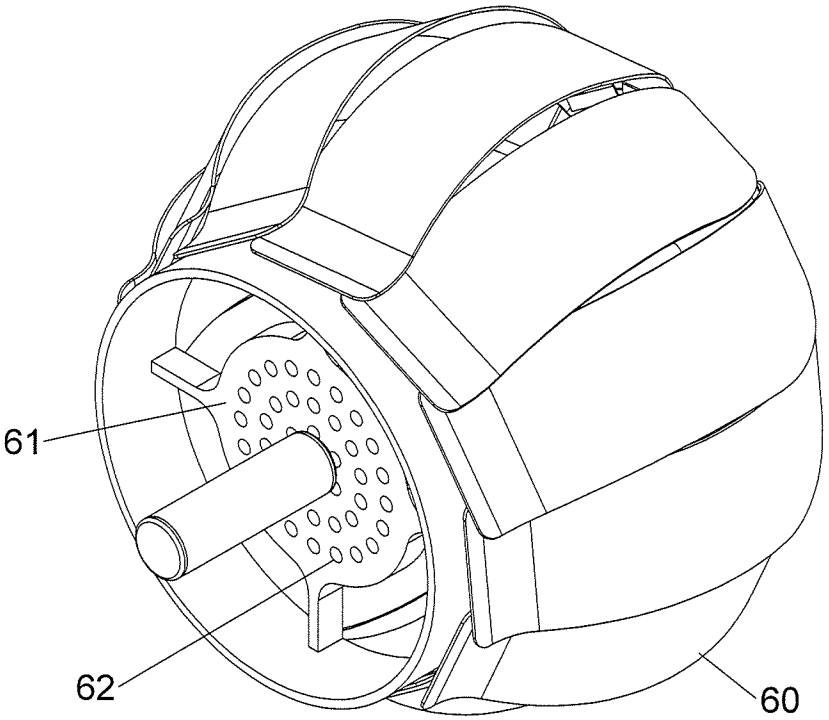
FIG. 14 is a perspective view to show the turbine unit of the sixth embodiment of the aeration device of the present invention.

As shown in FIG. 14, a second disk 61 is connected to the turbine unit and has multiple second apertures 62. Air may enter into the turbine unit 60 from the second apertures 62.

In another embodiment, the connection member 20 is integrally formed with the first connector 41, and the second threaded portion 411 of the first connector 41 is directly connected to the first connection portion 11.

The advantages of the present invention are that when the air enters into the pipe 10, the shell 70 guides the liquid to enter into the second room 54 and the third room 71, and the then the air enters into the turbine unit 60. The liquid and the air are mixed efficiently.

Generally, the pipe 10 is located at the bottom of the pound, the first end 72 of the shell 70 is located close to the bottom of the pound. The liquid that is located at the bottom of the pound can be guided into the third room 71 by the shell 70 so as to be mixed with the air. The shell 70 is able to stir the liquid located at the middle portion and the bottom portion of the pound toward higher position, this increases the efficiency of mixing of the liquid and air.

Air and other particles or substances enter into the pipe 10, and pass through the first passage 414, the first room 415, the third passages 422 and the second room 54, and then enter into the turbine unit 60. The air is supplied by a compressor into the pipe 10, the energy of the air drives the turbine unit 60 so that the blades rotates 360 degrees to spread air into the liquid.

The turbine unit 60 is operated by the energy brought by the air so as to stir the liquid in the pound to be mixed with air.

The turbine unit 60 is operated by the energy of the air, so that no extra electric power source is needed.

Turbine unit 60 is operated by the energy of the air, so that the whole aeration device does not need air-tight design.

When the air passes through the first connector 41 of the first connection unit 40, the air energy pushes the one-way member 43 upward to open the first passage 414. Therefore, the air is able to pass through the first passage 414, the first room 415, the third passages 422 and the second room 54, and enters into the turbine unit 60. The one-way member 43 can stop the liquid in the pound from entering into the pipe 10.

While we have shown and described the embodiment in accordance with the present invention, it should be clear to those skilled in the art that further embodiments may be made without departing from the scope of the present invention.

What is claimed is:

1. An aeration device comprising:

a pipe having a first connection portion which has a first axis, the pipe adapted to be connected with a piping system;

a connection member having a second connection portion on an outside thereof, the second connection portion being securely connected to the first connection portion, the connection member having a first threaded portion defined in an inside thereof, a hexagonal flange extending radially from one end thereof;

a connection unit connected to the connection member and comprising a first connector, a first connection part and a one-way member which is a bead, the first connector having a second threaded portion defined in an outside thereof, the second threaded portion connected to the first threaded portion to connect the first connector to the connection member, the first connector having a cone-shaped first opening which faces an interior of the pipe, the first connector having an inclined first contact portion, a first passage defined between the first opening and the first contact portion, and communicating with the first opening, a first room defined in the first connector and communicating with the first passage, the first passage defined between the first opening and the first room, the first connection part received in the first room and having a first assembly portion which communicates with the first room, multiple third passages defined in the first connection part and located around the first assembly portion, the third passages communicating with the first room, the one-way member contacting the first contact portion to seal the first passage, the one-way member adapted to be pushed by air entering into the pipe via the first opening and being moved upward to open the first passage;

a second connector connected to the connection unit and having a second assembly portion which is inserted into the first assembly portion of the first connection part, the second assembly portion having a third assembly portion, the second connector having multiple ribs which are connected between the second assembly portion and an inner periphery of the second connector, a second room defined in the second connector and communicating with the third passages;

a turbine unit pivotably connected to the second connector and having a bearing set, a turbine seat and multiple blades, the bearing set received in the third assembly portion, the turbine seat pivotably connected to the second connector, the blades connected to the turbine seat which rotates with the second connector, and a shell connected to outside of the second connector to hide the first connection unit and the second connector in the shell, a third room defined in the shell and communicating with the second room, the third room located corresponding to the pipe and the second connector, the shell having a first end at a lower end thereof, the first end located close to the first axis of the pipe, or the first end is located lower than the first axis of the pipe, the shell having a second end on a top thereof, the shell having a curved recess which is matched with the pipe.

2. The aeration device as claimed in claim 1, wherein the second connector has a first engaging portion at one end thereof, the second end of the shell is located higher than the first engaging portion and has a second engaging portion which is engaged with the first engaging portion to connect the shell to the second connector.

3. The aeration device as claimed in claim 1, wherein the shell includes two parts and each part has multiple connection holes, the two parts are connected to each other and multiple fasteners extend through the connection holes of the two parts to form the shell.

4. The aeration device as claimed in claim 1, wherein the shell is an integral shell and is mounted to outside of the second connector.

5. The aeration device as claimed in claim 3, wherein the shell is force-fitted to the second connector.

6. The aeration device as claimed in claim 1, wherein the shell is an integral shell and is integrally formed with the second connector.

7. The aeration device as claimed in claim 1, wherein the second connector has a first disk which is connected to the ribs and has multiple first apertures, the first disk is integrally connected to the second connector, or the first disk is connected to the second connector.

8. The aeration device as claimed in claim 1, wherein a second disk is connected to the turbine unit and has multiple second apertures.

9. The aeration device as claimed in claim 1, wherein the connection member is integrally formed with the first connector, the second threaded portion of the first connector is connected to the first connection portion.

* * * * *